United States Patent [19]

Dukes, Jr.

[11] Patent Number: 4,912,867

[45] Date of Patent: Apr. 3, 1990

[54] FIREARM SAFETY APPARATUS AND METHOD OF USING SAME

[76] Inventor: Paul R. Dukes, Jr., 520 W. Harrison St., Maumee, Ohio 43537

[21] Appl. No.: 401,061

[22] Filed: Aug. 31, 1989

[51] Int. Cl.[4] ..... F41C 27/00

[52] U.S. Cl. ..... 42/70.11; 224/238; 224/912

[58] Field of Search ..... 42/70.11; 224/198, 238, 224/247, 911, 912

[56] References Cited

U.S. PATENT DOCUMENTS

| | | | |
|---|---|---|---|
| Re. 30,139 | 11/1979 | Jones | 224/911 |
| 835,349 | 11/1906 | Deming | 42/70.11 |
| 1,513,267 | 10/1924 | Parks | 42/70.11 |
| 3,550,822 | 12/1970 | Lloyd | 42/70.11 |
| 3,910,469 | 10/1975 | Baldocchi | 224/198 |
| 4,342,410 | 8/1982 | Sloan | 224/911 |
| 4,392,318 | 7/1983 | Daniels | 42/70.11 |
| 4,395,837 | 8/1983 | Durnal | 42/70.11 |
| 4,412,397 | 11/1983 | Bayn | 42/70.11 |
| 4,569,144 | 2/1986 | Thurber | 42/70.11 |
| 4,694,980 | 9/1987 | Rogers | 224/911 |

*Primary Examiner*—Deborah L. Kyle
*Assistant Examiner*—Richard W. Wendtland
*Attorney, Agent, or Firm*—Marshall & Melhorn

[57] ABSTRACT

A firearm safety apparatus and method of using same are disclosed. The apparatus comprises a sleeve formed of a flexible plastic material capable of being flexed from a normal position to a flexed position to surroundingly receive an associated firearm and spring urged lever means for locking the hammer of the associated firearm in the uncocked position. The sleeve has front and rear ends, the rear end being open to receive the associated firearm and the front end having an aperture to receive the barrel of the associated firearm. The spring urged lever means includes a lever arm rotatably mounted within the sleeve by a pivot pin. In the operative position, a spring urges the end portion of the lever arm downwardly to engage the hammer of the associated firearm, thereby locking the hammer in the uncocked position.

7 Claims, 2 Drawing Sheets

FIREARM SAFETY APPARATUS AND METHOD OF USING SAME

BACKGROUND OF THE INVENTION

The present invention relates to firearms and more particularly to a safety apparatus for rendering firearms inoperative in the hands of small children.

While it is accepted firearm safety practice to render firearms inoperative during periods of transportation and storage, there are instances when handguns, in particular, must be available for immediate use for homestead protection, for example. In such instances, small children may well have access to such firearms.

Although there have been many safety devices designed to effectively disable firearms and thereby render the firearms safe from unauthorized use, these devices have certain limitations which the present invention is designed to ovrcome.

Exemplary of the prior art is a device illustrated and described in U.S. Pat. No. 1,513,267 entitled SAFETY GUARD and issued on Oct. 28, 1924 to Parks. The device of the patent to Parks includes a hinged guard which is adapted to be locked in surrounding relation in respect of the hammer and trigger assembly of the firearm. The Parks device must be locked in place and therefore, the associated firearm may not be readily and rapidly rendered operative. Manifestly, removal problems are somewhat further complicated in the event the associated key is misplaced or lost.

Another prior art device for rendering a firearm temporarily inoperative is illustrated and described in U.S. Pat. No. 4,392,318 entitled SAFETY STRAP FOR HANDGUNS issued on July 12, 1983 to Daniels. The Daniels' device includes a safety strap which is designed to surround a portion of the body of a handgun to maintain the hammer in a cocked position. While in the snapped position, the strap effectively renders the associated handgun inoperative. Still another prior art device for rendering a firearm temporarily inoperative is the subject matter of U.S. Pat. No. 4,644,676 entitled FIREARM SAFETY APPARATUS issued on Feb. 24, 1987 to Stern. The Stern invention includes a band of flexible material wrapped around the trigger guard, trigger, and breech of the firearm. One end of the band is detachably coupled to the other, securing the band in place to prevent inadvertent contact with the trigger of the firearm.

While the above illustrated and described devices are effective to temporarily render a firearm inoperative, in each instance an unsupervised child could disengage the safety mechanism thereby rendering the firearm in fully operative condition.

It is therefore an object of the present invention is to produce a safety apparatus for firearms which will selectively, as well as effectively, render a firearm inoperative and which, in turn, may be removed from the firearm with facility by adults but which is not removable by small children.

SUMMARY OF THE INVENTION

The aforementioned problems are solved and objectives achieved by the present invention.

The invention employs a firearm safety apparatus and method of using the same which effectively and positively renders a firearm inoperative, yet which can be rapidly removed when necessary by adults but not small children.

The apparatus comprises a main portion including a sleeve having rear and front ends, the rear end being open to receive the trigger assembly of an associated firearm. The sleeve is formed of a flexible material capable of being flexed from a normal position to a flexed position to receive an associated firearm and returning to the normal position after being flexed. The apparatus includes spring urged lever means rotatably mounted within said sleeve to effectively lock the hammer of the associated firearm in the uncocked position.

BRIEF DESCRIPTION OF THE DRAWINGS

The above as well as other objectives and advantages of the invention will become readily apparent to one skilled in the art from reading the following detailed description of the preferred embodiment of the invention when considered in light of the accompanying drawings, in which.

DETAILED DESCRIPTION OF THE PREFERRED EMBODIMENT

Figure 1:
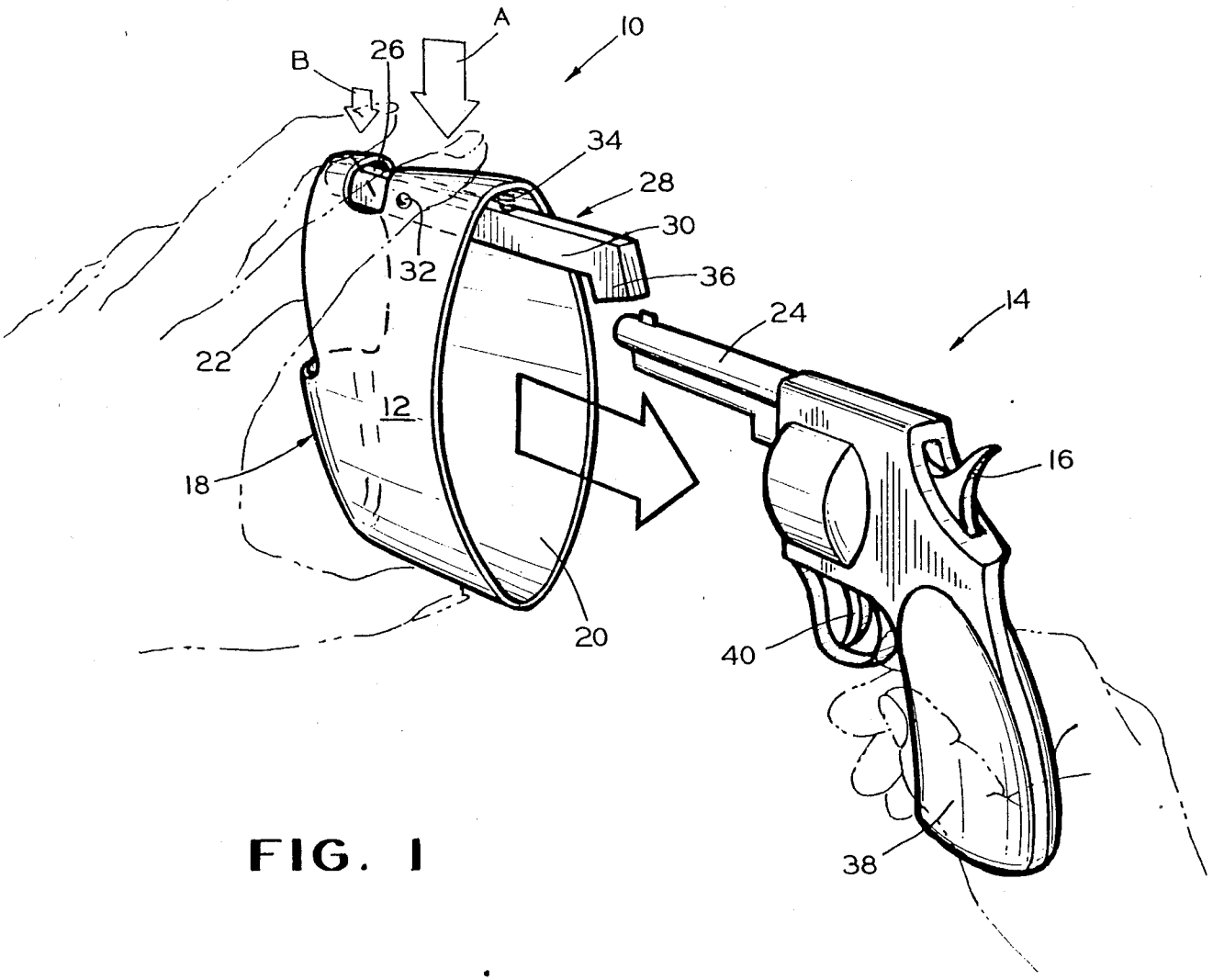
FIG. 1 is a perspective view of the safety apparatus incorporating the features of the invention preparatory to being placed in the operative position in respect of an associated firearm.

A firearm safety apparatus in according with the invention is illustrated in the drawings, wherein like reference numerals are used to illustrate like elements throughout. With particular reference to FIG. 1, the safety apparatus of the invention is identified generally by reference numeral 10, and comprises a main body portion or sleeve 12 adapted to surroundingly receive an associated firearm 14 in a manner so as to prevent the cocking of the hammer 16 and the discharge of the associated firearm. The sleeve 12 is normally formed with an elliptical cross-section and maintains its original shape in the relaxed position. The sleeve 12 includes a front end 18 and a rear end 20. the rear end 20 of the sleeve 12 is completely open to allow easy insertion of the associated firearm 14. The front end 18 of the sleeve 12 includes an aperture 22 for receiving the barrel 24 of the associated firearm 14. The sleeve 12 is further provided with an opening 26 on the top of the sleeve 12 adjacent the front end 18 thereof, to allow the user access to lever means 28 for locking the hammer 16 of the associated firearm 14 in the uncocked position.

Figure 2:
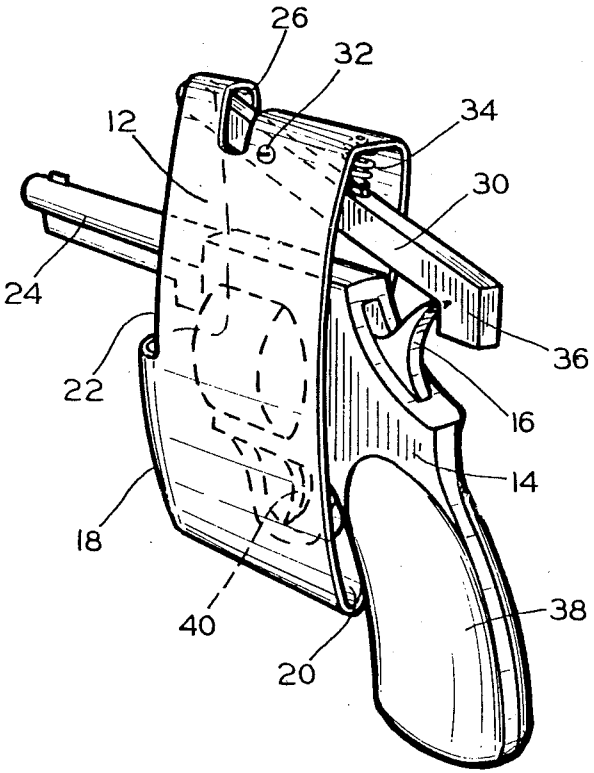
FIG. 2 is perspective view of the safety apparatus illustrated in FIG. 1 in the operative position on the associated firearm.

The lever means 28 more particularly includes a lever arm 30 pivotally mounted within the interior of the sleeve 12 by a pivot pin 32 attached to the sleeve 12 so that the lever arm 30 pivots about the pin 32 on an axis perpendicular to the longitudinal axis of the sleeve 12. The pin 32 is positioned closer to the rear end 20 of the sleeve 12 than is the opening 26 in the top of the sleeve 12, with at least a portion of the lever arm 30 extending beyond the pin 32 to a position directly beneath the opening 26. The lever arm 30 is maintained in the normal or operative position, as illustrated in FIG. 2, by a helical spring 34. The helical spring 34 is disposed adjacent the rear end 20 of the sleeve 12 between the inner surface of the top of the sleeve 12 and the lever arm 30, and is effective to urge the lever arm 30 downwardly to cause an end portion 36 of the lever arm 30 to engage the hammer 16 of the firearm 14 so as to restrict any relative movement between the sleeve 12 and the firearm 14, and to lock the hammer 16 as will be described in more detail hereinafter.

The sleeve 12 is fabricated from a non-stretchable, flexible material such as a plastic material. It has been found that a thermoplastic polymer such as polypropylene, for example, exhibits satisfactory results for the formation of the sleeve 12. It will be appreciated that the material from which the sleeve 12 is fabricated must be strong and exhibit sufficient flexibility to be depressed to permit the associated firearm 14 to be introduced into and withdrawn out of the sleeve 12 when in a flexed position, and then return to its normal, relaxed shape. The lever arm 30 is typically formed and fabricated from a rigid, inflexible material such as plastic or metal.

The associated firearm 14 generally includes a stock or handle 38 and a barrel 24. Additionally, the firearm 14 includes a trigger 40 operatively connected to the hammer 16. When the firearm 14 is disposed in the operative position within the sleeve 12, the trigger 40 is housed within the interior of the sleeve 12 and the hammer 16 is locked in the uncocked position by the action of the end portion 36 of the lever arm 30, thereby rendering the firearm 14 inoperative and protecting against accidental and unauthorized use thereof.

In operation, the user would typically grasp the sleeve 12 with one hand, while the other hand grasps the stock or handle 38 of the firearm 14 as illustrated in FIG. 1. Thereafter, the user would squeeze the sleeve 12 between one or more of the user's fingers and the user's thumb, by pressing the finger or fingers in the direction of the arrow A, thereby compressing the sleeve 12 into the flexed position. Concurrently, the user would press one finger downwardly through the opening 26 in the top of the sleeve 12, in the direction of the arrow B, to urge downwardly the end of the lever arm 30 opposite the end portion 36. The lever arm 30 is thereby caused to pivot about the pin 32, forcing the end portion 36 of the lever arm 30 upwardly and compressing the helical spring 34.

With the sleeve 12 in the flexed position and the end portion 36 of the lever arm 30 forced upwardly, a firearm 14 may be introduced into the sleeve 12. The firearm 14 is positioned within the sleeve 12 so that the barrel 24 extends through the aperture 22 in the front end 18 of the sleeve 12 and the end portion 36 of the lever arm 30 extends over the hammer 16. Once the firearm 14 is so positioned, the user would relax the fingers and thumb of the hand gripping the sleeve 12, allowing the sleeve 12 to return to its normal, unflexed position and allowing the spring 34 to urge the end portion 36 of the lever arm 30 downwardly, as shown in FIG. 2. In this position, the trigger 40 is housed within the sleeve 12, making access to the trigger 40 difficult if not impossible. Further, the end portion 36 of the lever arm 30 is forced into engagement with the hammer 16,locking the hammer 16 in the uncocked position and preventing any relative movement between the apparatus 10 and the firearm 14. The apparatus 10 thereby renders the firearm 14 inoperative.

Figure 3:
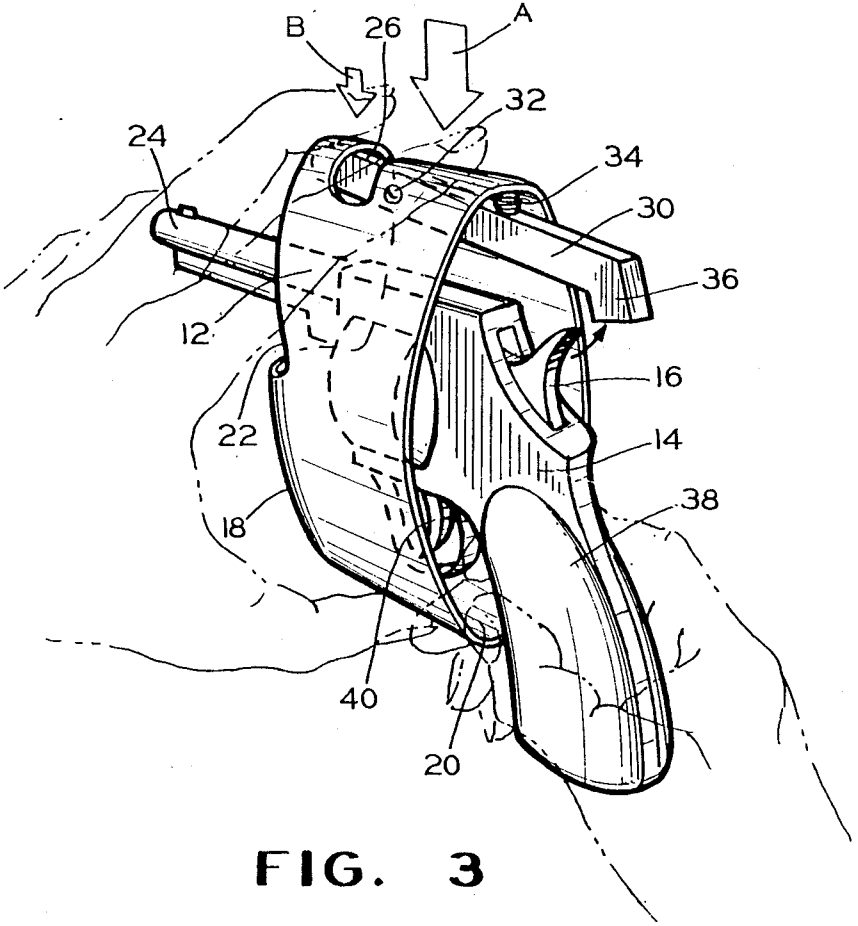
FIG. 3 is a perspective view of the safety apparatus illustrated in FIGS. 1 and 2 preparatory to being removed from the associated firearm.

In order to place the firearm 14 back in an operative condition, the aforedescribed procedure is repeated by simultaneously compressing the sleeve 12 and depressing the end of the lever arm 30 through the opening 26, thereby causing the lever arm 30 to pivot about the pin 32, which effectively lifts the end portion 36 of the lever arm 30 from the hammer 16 as illustrated in FIG. 3. While the user maintains the sleeve 12 in a compressed or flexed position and keeps the end portion 36 of the lever arm 30 urged against the bias of the helical spring 34 with one hand, the firearm 14 may be easily withdrawn from the apparatus 10 by the opposite hand of the user.

It will be understood that the apparatus of the present invention will provide protection from the unauthorized use of firearms by small children since they generally lack the hand size, strength and dexterity that is necessary to effectively compress the sleeve 12, while simultaneously depressing the lever arm 30 through the opening 26, in order to withdraw the firearm 14 from the apparatus 10. A child's hand is generally unable to perform the motions necessary for removal of the safety apparatus from the firearm, especially since the physical dimensions of the sleeve are such that a small child's hand would generally not be large enough to span the distance between the top and bottom of the sleeve 12 to compress the elliptically shaped sleeve 12 along its major axis. Furthermore, the necessary strength required to deform the sleeve 12 would also militate against the ability of a small child to compress the sleeve 12.

On the other hand, it will be appreciated that the firearm safety apparatus of the present invention and the described method of using the same allows an adult user easy and almost instantaneous access to the firearm when necessary.

It will therefore be appreciated that the present invention produces a firearm safety apparatus and method of using the same which effectively solves the problems and the short comings of the prior art by preventing children from removing the firearm from the safety apparatus while simultaneously maintaining instant adult user access when necessary.

What is claimed is:

1. A firearm safety apparatus comprising:

(a) a main portion including a sleeve having rear and front ends, the rear end being open to receive the trigger assembly of an associated firearm, said sleeve being formed of a flexible material capable of being flexed from a normal position to a flexed position to receive an associated firearm and to return to the normal position after being flexed; and (b) spring urged lever means rotatably mounted within said sleeve to effectively lock the hammer of the associated firearm in an uncocked position.

2. The invention as defined in claim 1, wherein said sleeve is formed of a flexible thermoplastic polymer.

3. The invention is defined in claim 2, wherein said polymer comprises polypropylene.

4. The invention as defined in claim 1, wherein said lever means includes a helical spring.

5. The invention as defined in claim 1, wherein the front end of said sleeve includes an aperture for receiving the barrel of the associated firearm.

6. The invention as defined in claim 1, wherein said sleeve includes an opening on the top thereof to provide access to said lever means.

7. The invention as defined in claim 1, wherein said lever means includes a pivotally mounted lever arm capable of selective locking engagement with the hammer of the associated firearm.

* * * * *